US006438334B1

(12) United States Patent
Honma

(10) Patent No.: US 6,438,334 B1
(45) Date of Patent: Aug. 20, 2002

(54) IMAGE OUTPUT APPARATUS AND CONTROL METHOD THEREFOR

(75) Inventor: Koichi Honma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/599,961

(22) Filed: Jun. 23, 2000

(30) Foreign Application Priority Data

Jun. 28, 1999 (JP) ..... 11-182421

(51) Int. Cl.[7] ..... G03G 15/20
(52) U.S. Cl. ..... 399/67; 399/69
(58) Field of Search ..... 399/33, 43, 67, 399/68, 69, 71, 320, 322, 327, 328; 219/216; 347/156; 430/97, 99, 124, 125; 118/60, 101, 104

(56) References Cited

U.S. PATENT DOCUMENTS 4,367,690 A * 1/1983 Sakaguchi et al. ..... 118/60
4,825,242 A * 4/1989 Elter ..... 399/67
5,168,314 A * 12/1992 Gunji et al. ..... 399/327
5,489,761 A * 2/1996 Aslam et al. ..... 219/216
5,857,131 A * 1/1999 Hasegawa ..... 399/43 X
6,026,255 A * 2/2000 Kizaki et al. ..... 399/43

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

An image output apparatus capable of preventing occurrence of quality degradation problem due to fixing failure such as fixing offset at a low cost, by rotating fixing rollers at timing other than that of paper discharge processing. An engine transfers a toner image generated based on image information onto a print sheet, and fixes the transferred toner image to the print sheet by a fixer with fixing rollers. A number of print sheet detector detects whether or not the number of discharged pages has become a predetermined number, and if the number of discharged pages has become the predetermined number, the fixing rollers are rotated for a predetermined period after the completion of page discharge, by an instruction of post rotation instructor.

21 Claims, 12 Drawing Sheets

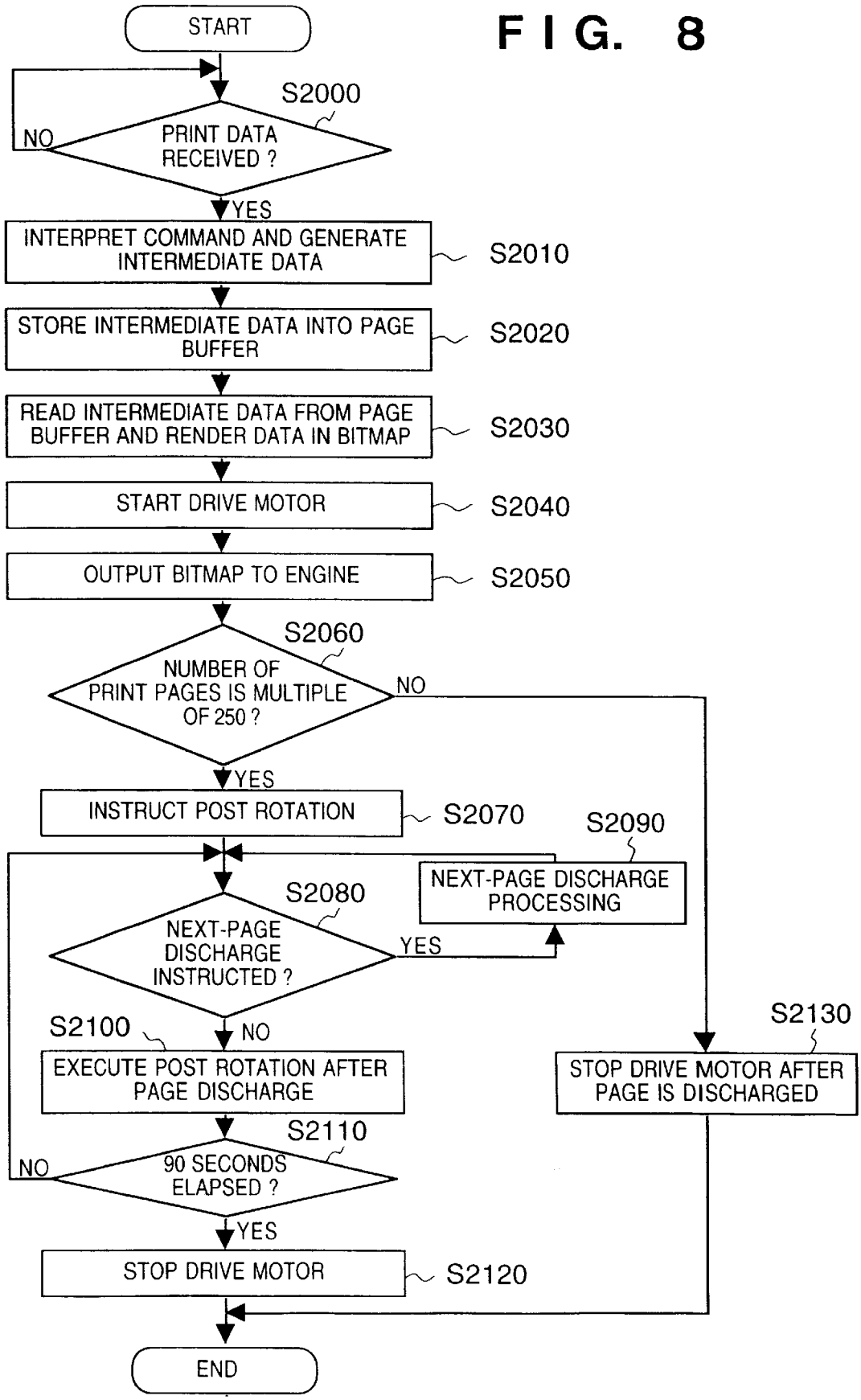
FIG. 8
START
S2000
PRINT DATA RECEIVED ?
NO
YES
INTERPRET COMMAND AND GENERATE INTERMEDIATE DATA
S2010
STORE INTERMEDIATE DATA INTO PAGE BUFFER
S2020
READ INTERMEDIATE DATA FROM PAGE BUFFER AND RENDER DATA IN BITMAP
S2030
START DRIVE MOTOR
S2040
OUTPUT BITMAP TO ENGINE
S2050
S2060
NUMBER OF PRINT PAGES IS MULTIPLE OF 250 ?
NO
YES
INSTRUCT POST ROTATION
S2070
S2090
NEXT-PAGE DISCHARGE PROCESSING
S2080
NEXT-PAGE DISCHARGE INSTRUCTED ?
YES
NO
S2100
EXECUTE POST ROTATION AFTER PAGE DISCHARGE
S2130
STOP DRIVE MOTOR AFTER PAGE IS DISCHARGED
S2110
90 SECONDS ELAPSED ?
NO
YES
STOP DRIVE MOTOR
S2120
END

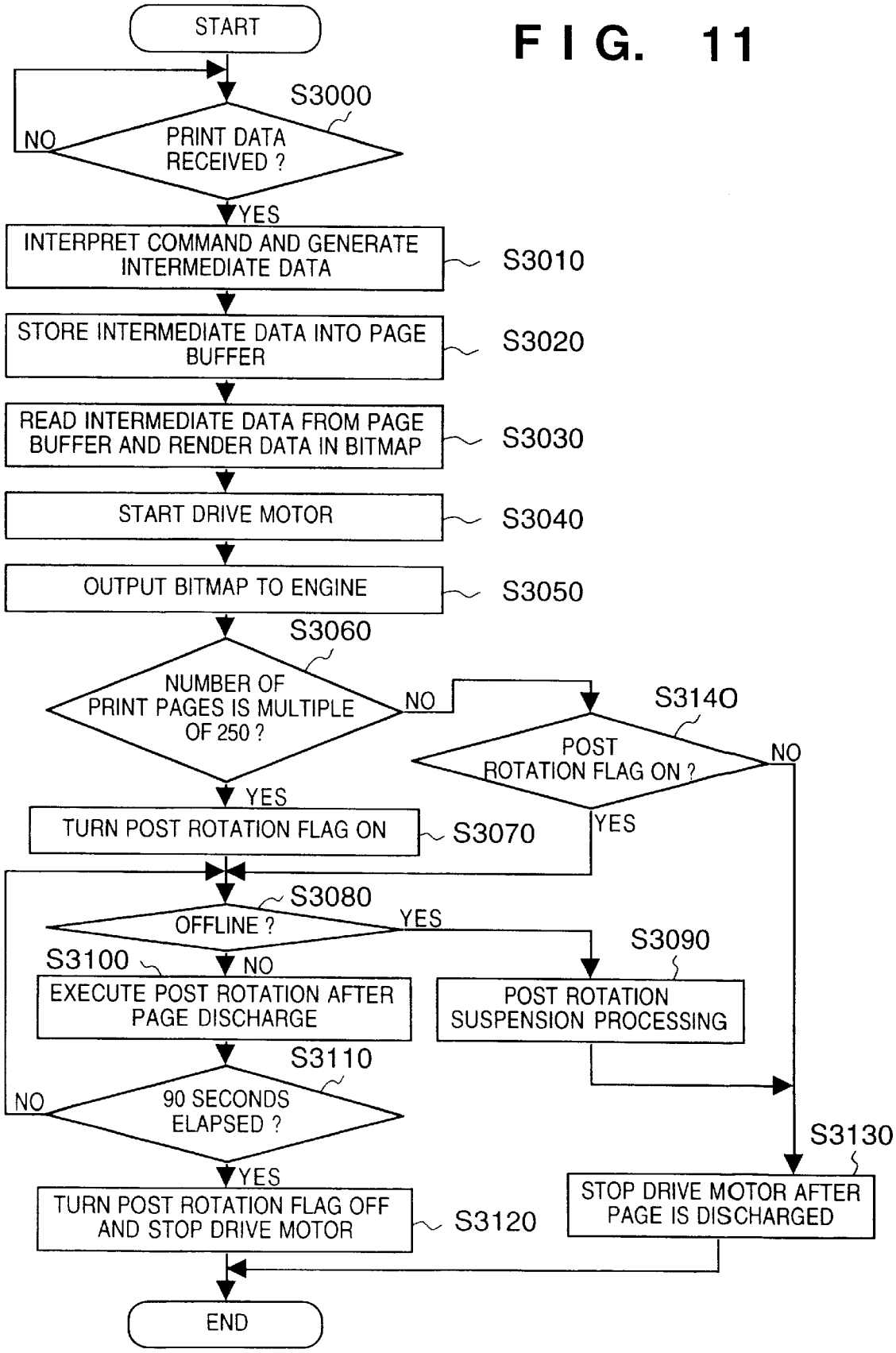
FIG. 11
START
S3000
PRINT DATA RECEIVED ?
NO
YES
INTERPRET COMMAND AND GENERATE INTERMEDIATE DATA
S3010
STORE INTERMEDIATE DATA INTO PAGE BUFFER
S3020
READ INTERMEDIATE DATA FROM PAGE BUFFER AND RENDER DATA IN BITMAP
S3030
START DRIVE MOTOR
S3040
OUTPUT BITMAP TO ENGINE
S3050
S3060
NUMBER OF PRINT PAGES IS MULTIPLE OF 250 ?
NO
YES
S3140
POST ROTATION FLAG ON ?
NO
YES
TURN POST ROTATION FLAG ON
S3070
S3080
OFFLINE ?
YES
NO
S3100
EXECUTE POST ROTATION AFTER PAGE DISCHARGE
S3090
POST ROTATION SUSPENSION PROCESSING
S3110
90 SECONDS ELAPSED ?
NO
YES
TURN POST ROTATION FLAG OFF AND STOP DRIVE MOTOR
S3120
S3130
STOP DRIVE MOTOR AFTER PAGE IS DISCHARGED
END

IMAGE OUTPUT APPARATUS AND CONTROL METHOD THEREFOR

FIELD OF THE INVENTION

The present invention relates to an image output apparatus such as a printer connected to a host computer or the like and a control method for the apparatus.

BACKGROUND OF THE INVENTION

Conventionally, an image output apparatus such as a well-known laser-beam printer is connected to a host computer with a standard interface cable. When image data described in PDL (Page Description Language) is inputted from the host computer, the image data is interpreted and bitmap data is generated. Then, to output the data to a printer engine, the bitmap data is converted into a binary signal, thus hard copy output is produced from the printer.

The printer engine of this laser-beam printer transfers an image formed with print material called toner based on the binary signal onto a print medium, and fixes the transferred image onto the print medium by a fixer having fixing rollers and a fixing heater.

In recent years, it has been a trend to provide printers with an increased printing speed and energy-saving and low-cost structure.

However, a general laser-beam printer has a problem of fixing failure such as fixing offset in the fixer. The fixing offset means attachment of toner via a pair of fixing rollers to print sheets. Specifically, upon fixing processing, if toner is attached to the print-surface side roller, the toner is attached to the rear-surface side fixing roller, and is attached to the subsequent pages of print sheets. Especially, in a high-speed printer, the fixing failure such as fixing offset tends to be noticeable when printing has been performed to a certain extent. To address the problem, a special cleaning mechanism may be provided, however, in consideration of recent energy-saving and low-price requirements, such additional mechanism should be omitted as much as possible.

Accordingly, as countermeasures against the fixing failure without cleaning mechanism, a user manually cleans the fixer, or periodically inserts cleaning paper into the fixer.

As described above, it is preferable to clean the fixer every predetermined number of print sheets, however, in a case where the special cleaning mechanism is provided, the cost increases for the mechanism, and in a case where the user's operation is required, the user must be aware of periodical cleaning operation and the user might forget it, further, the user must do it at much expense in time and effort.

SUMMARY OF THE INVENTION

The present invention has been made in consideration of the above problems, and has its object to prevent quality degradation due to fixing failure such as fixing offset or the like at a low cost.

According to the present invention, the foregoing object is attained by providing an image output apparatus comprising: transfer means for transferring a toner image generated based on image information onto a print sheet; fixing means, having a fixing roller, for fixing the toner image transferred onto the print sheet to the print sheet; and rotation control means for rotating the fixing roller for a predetermined period at timing other than that of fixing operation.

Preferably, the image output apparatus further comprises detection means for detecting whether or not a predetermined number of pages have been discharged, wherein if the detection means detects that the predetermined number of pages have been discharged, the rotation control means rotates the fixing roller for the predetermined period after page discharge.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 8 is a flowchart showing the process procedure of the image output apparatus according to the second embodiment;

FIG. 11 is a flowchart showing the process procedure of the image output apparatus according to the third embodiment.

DETAILED DESCRIPTION OF THE PREFERRED EMBODIMENTS

Preferred embodiments of the present invention will now be described in detail in accordance with the accompanying drawings.

<First Embodiment>

Prior to explanation of the embodiments, the structure of a laser-beam printer to which the embodiments can be preferably applied will be described with reference to FIG. 1. Note that the printer to which the embodiments are applied is not limited to the laser-beam printer as described below but may be any other type electrophotographic printer.

Figure 1:
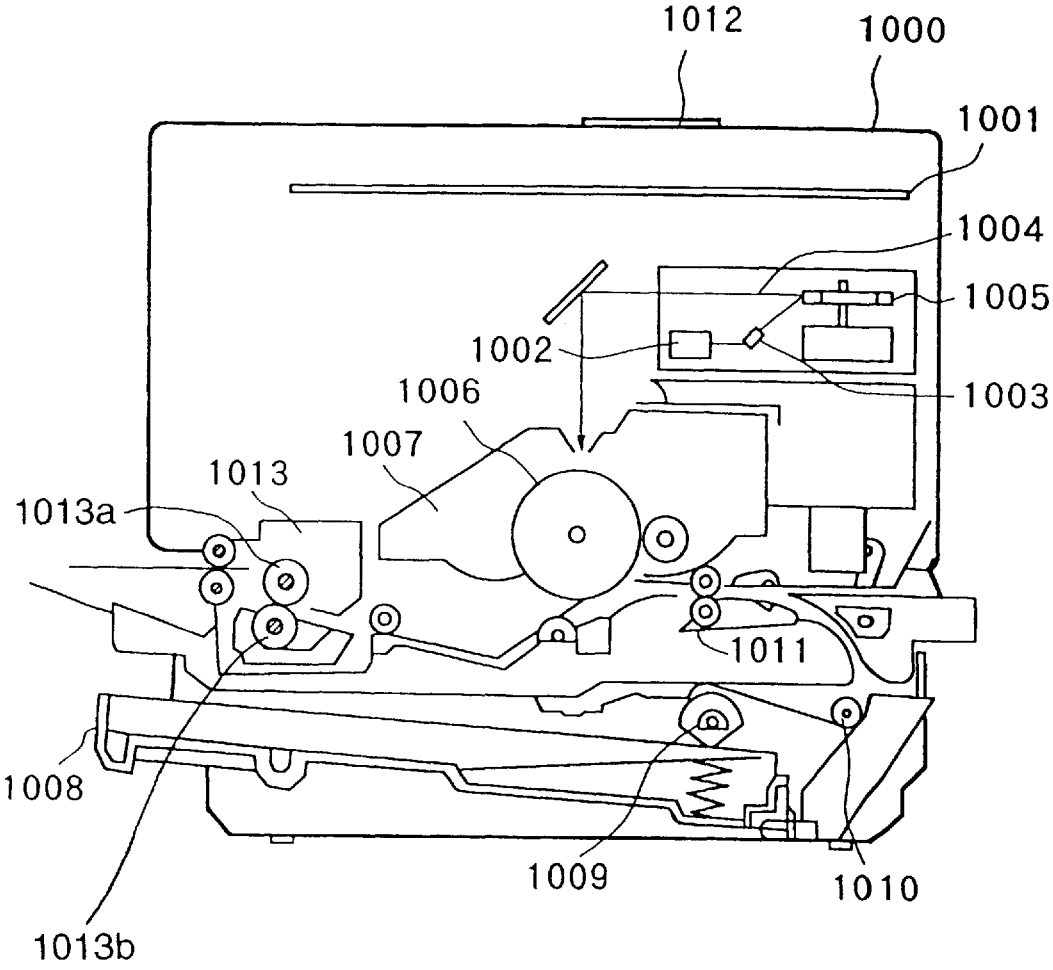
FIG. 1 is a cross-sectional view showing the structure of an image output apparatus to which the present invention can be applied.

FIG. 1 a cross-sectional view showing the structure of an image output apparatus, i.e., the laser-beam printer (LBP) to which the present invention can be applied.

In FIG. 1, reference numeral 1000 denotes an LBP main body which inputs and stores print information (character code and the like), form information, macro command or the like, supplied from a host computer as an external device connected to the printer, generates a character pattern, form pattern or the like corresponding to the information, and forms an image on a print sheet or the like as a print medium. Numeral 1012 denotes an operation panel having operation switches, an LED display device and the like; and 1001, a printer control unit which controls the overall LBP main body 1000 and interprets character information or the like supplied from the host computer. The printer control unit 1001 mainly converts character information into a video signal of corresponding character pattern and outputs the signal to a laser driver 1002.

The laser driver 1002 is a circuit to drive semiconductor laser 1003. The laser driver 1002 turns on/off laser light 1004 emitted from the semiconductor laser 1003 in accordance with an input video signal. The laser light 1004, swayed leftward/rightward by a rotary polygon mirror 1005, scan-exposes an electrostatic drum 1006. By the exposure, an electrostatic latent image of character pattern is formed on the electrostatic drum 1006. The latent image is developed by a development unit 1007 provided around the electrostatic drum 1006 and is transferred onto a print sheet.

The print sheet is a cut sheet set in a paper cassette 1008 attached to the LBP 1000. The print sheet is fed into the apparatus by a paper-feed roller 1009 and conveyance rollers 1010 and 1011, and is supplied to the electrostatic drum 1006. The print sheet on which an image is transferred from the electrostatic drum 1006 is fixed by a fixer 1013, and is discharged. Further, the LBP main body 1000 has at least one card slot (not shown) for connection with an option font card and a control card for different language system (emulation card).

Note that the fixer 1013 has a pair of fixing roller 1013*a* and 1013*b*. Fixing is performed by inserting a print sheet holding an image transferred from the electrostatic drum 1006 between these fixing rollers.

Figure 2:
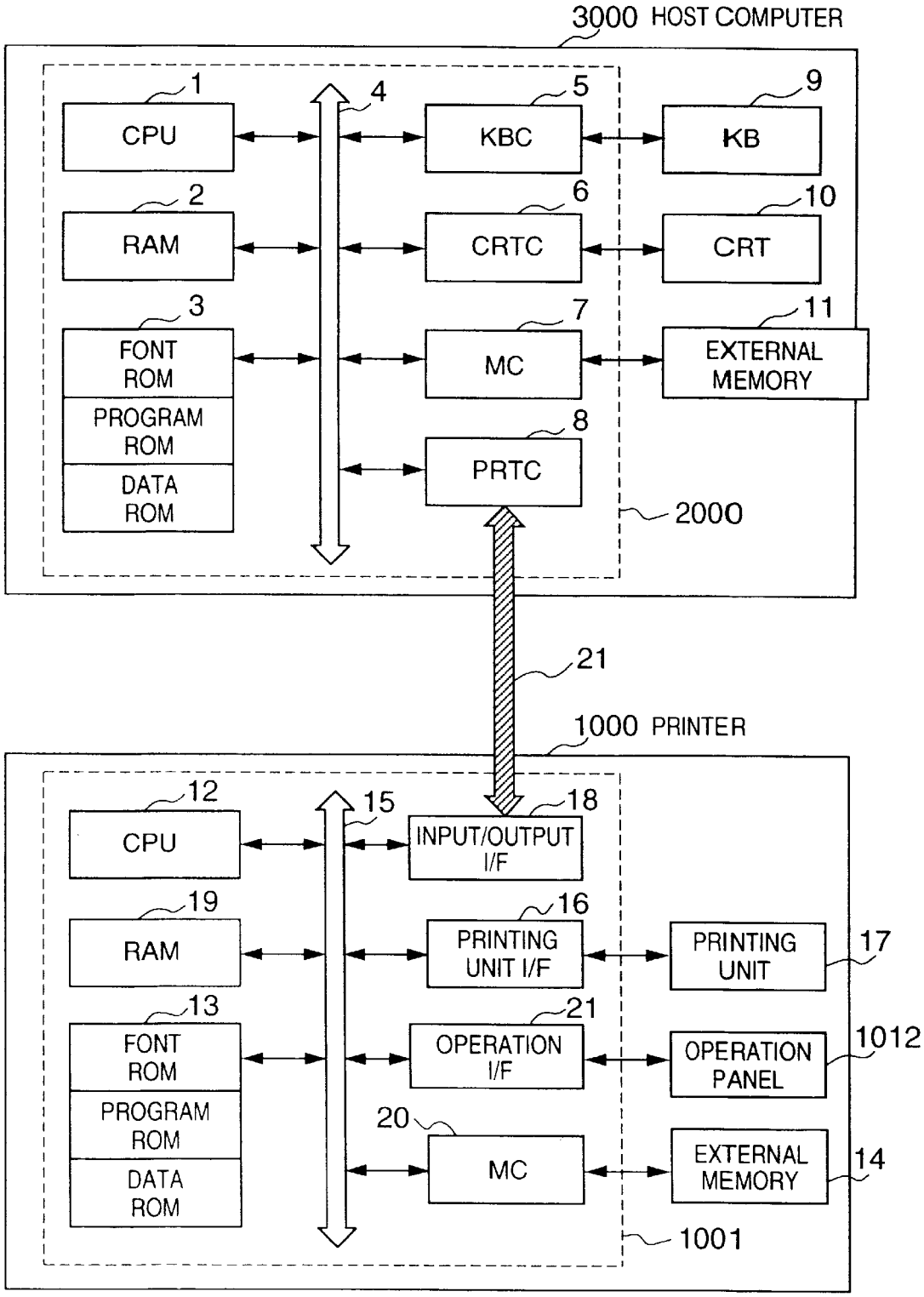
FIG. 2 is a block diagram showing the construction of a control system of the image output apparatus according to a first embodiment.

FIG. 2 is a block diagram showing the construction of a control system of the image output apparatus according to a first embodiment. Here explanation will be made on the laser-beam printer as shown in FIG. 1. Note that the present invention can be applied to a single device or a system constituted with a plurality of devices or a system to perform processing via a network such as a LAN, as long as the functions of the present invention can be executed.

In FIG. 2, reference numeral 3000 denotes a host computer having a CPU 1 which performs document processing on a document mixedly including a figure, an image, a character, a table (including a spreadsheet) and the like based on a document processing program or the like stored in a program ROM of a ROM 3. The CPU 1 controls the respective devices connected to a system bus 4. Further, a control program for the CPU 1 and the like are stored in the program ROM of the ROM 3. The ROM 3 has a font ROM in which font data used in the above document processing and the like are stored, and a data ROM in which various data (e.g., a format pattern and a test-print form) used in the above document processing are stored, as well as the program ROM.

Numeral 2 denotes a RAM which functions as a main memory, a work area or the like for the CPU 1; 5, a keyboard controller (KBC) which inputs a key input from a keyboard 9 or a pointing device (not shown); 6, a CRT controller (CRTC) which controls a display on a CRT display (CRT) 10; 7, a memory controller (MC) which controls access to a hard disk (HD) in which a boot program, various application programs, font data, a user file, an editing file and the like are stored and to an external memory 11 such as a floppy disk (FD); 8, a printer controller (PRTC) with a predetermined-standard bidirectional interface function, connected to a printer 1500 via an interface cable 21, which performs communication control processing for communication with the printer 1000.

Note that the CPU 1 executes rasterizing processing on outline font into a display information RAM set on e.g. the RAM 2, enabling WYSIWYG on the CRT 10. Further, the CPU 1 opens various windows registered based on commands designated by a mouse cursor (not shown) or the like on the CRT 10, and executes various data processing.

Next, the construction of the printer 1000 will be described.

In the printer control unit 1001 of the printer 1000, numeral 12 denotes a printer CPU which controls access to various devices connected to a system bus 15 based on a control program or the like stored in a program ROM of a ROM 13 or a control program or the like stored in an external memory, and which outputs an image signal as output information to a printing unit (printer engine 17) connected to the CPU via a printing unit interface 16. The control program for the CPU 12 and the like are stored in the program ROM of the ROM 13. The ROM 13 has a font ROM in which font data and the like used upon generation of the above output information are stored, and a data ROM in which information and the like utilized on the host computer in case of printer without the external memory 14 are stored, as well as the program ROM.

The CPU 12, capable of communication processing for communication with the host computer via an input/output interface 18, can inform the host computer 3000 of information and the like in the printer. Numeral 19 denotes a RAM which functions as a main memory, a work area or the like for the CPU 12. The memory capacity of the RAM 19 can be expanded with an option RAM connected to an expansion port (not shown). Note that the RAM 19 is used as an output information mapping area, an environmental data storage area, an NVRAM or the like. The above-described external memory 14 such as a hard disk (HD) or an IC card is access-controlled by a memory controller (MC) 20. The external memory 14 is connected as an option memory used for storing font data, emulation programs, form data and the like.

Further, an operation I/F 21 functions as an interface between the operation panel 1012 having operation switches and LED display device and the like and the printer control unit 1001 described in FIG. 1.

Further, the number of the external memories is not limited to one. It may be arranged such that an option font card for font other than the internally-stored font, and plural external memories containing programs to interpret printer control languages of different language systems, can be connected to the printer. Further, it may be arranged such that the printer has an NVRAM (not shown) for storing printer-mode setting information from the operation panel 1012.

Figure 3:
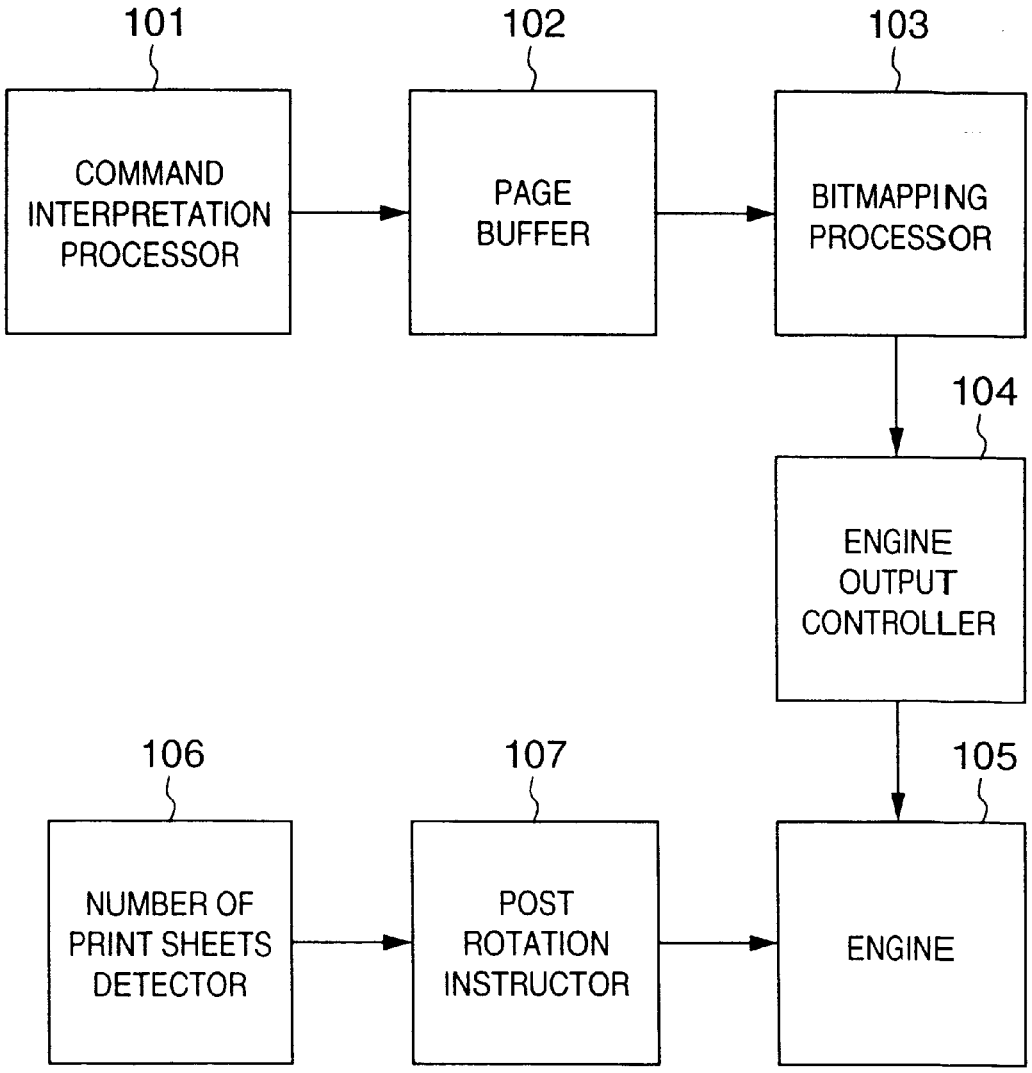
FIG. 3 is a block diagram showing a functional construction of the image output apparatus according to the first embodiment.
Figure 4:
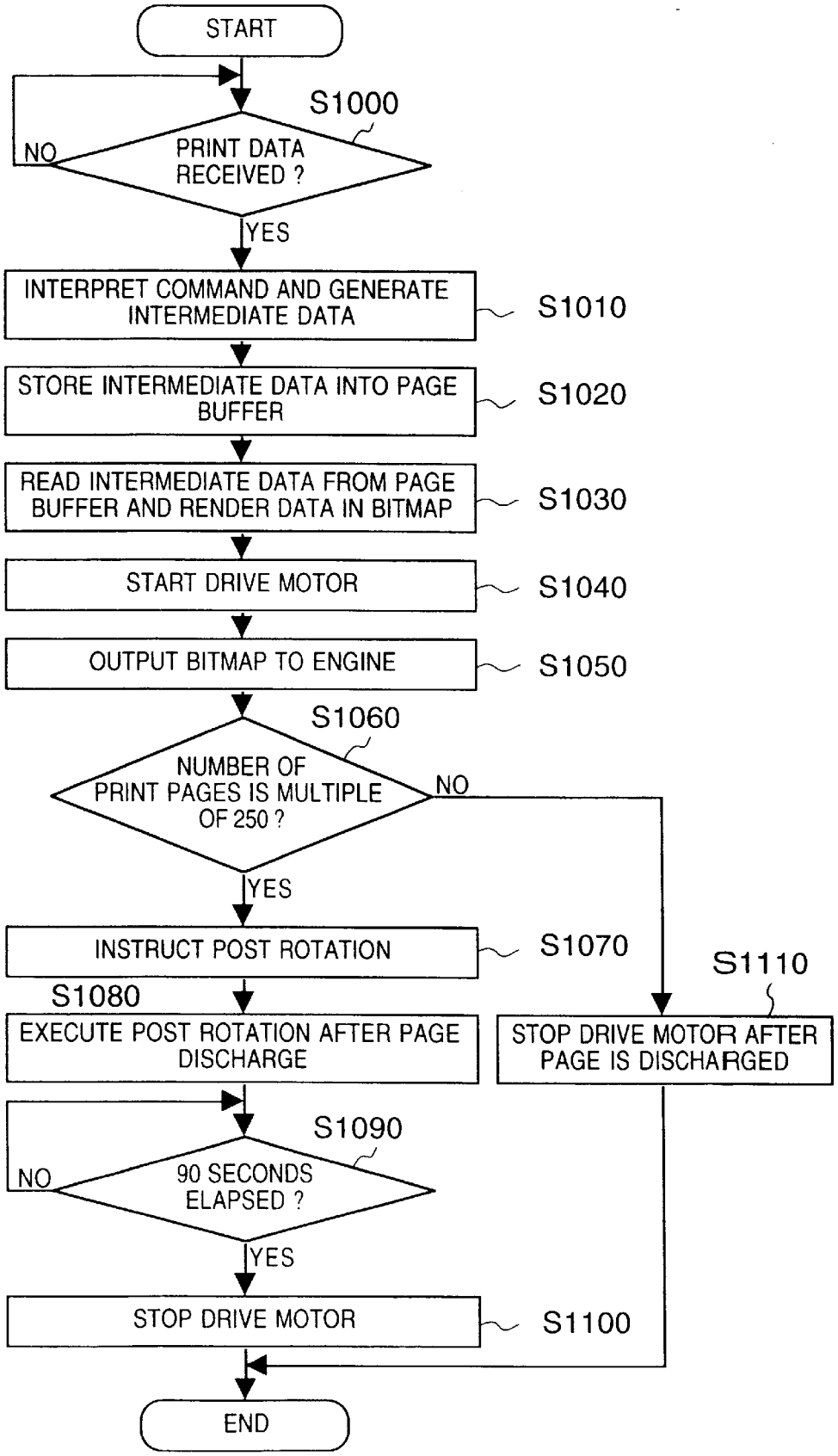
FIG. 4 is a flowchart showing a control procedure of the image output apparatus according to the first embodiment.

FIG. 3 is a block diagram showing a functional construction of the laser-beam printer according to the first embodiment. FIG. 4 is a flowchart showing a control procedure of the laser-beam printer according to the first embodiment. In the first embodiment, as a principle, when a 250×N-th (N=1, 2, 3, . . . ) print sheet has been discharged, rotation of fixing rollers for cleaning the fixing roller (hereinafter referred to as "post rotation") is performed. Hereinbelow, description will be made with reference to FIGS. 3 and 4. Note that the number of sheets "250" is merely an example.

When data is inputted from the host computer (not shown), the data is temporarily stored in a reception buffer (not shown), then a command interpretation processor 101 performs interpretation and editing on the command and generates intermediate data (steps S1000 and S1010). The generated intermediate data is stored into a page buffer 102 ensured in the RAM 19 (step S1020). The intermediate data stored in the page buffer 102 is sent to a bitmapping processor 103, then bitmapped, and held in the RAM 19 (step S1030). When the bitmap processing has been completed, a drive motor (not shown) of an engine 105 is started (step S1040). The bitmap is outputted by an engine output controller 104 to the engine 105 in synchronization with an engine synchronizing signal (not shown) and then printing and page discharge processing are performed (step S1050).

Note that the engine 105 has the units 1002 to 1011 and 1013 in FIG. 1, and the engine 105 conveys a print sheet, transfers an image to the print sheet, fixes the image, and discharges the print sheet.

A number of print sheets detector 106 determines whether or not the number of print sheets is 250×N (N=1, 2, 3, . . . )(step S1060). If the current sheet is a 250×N-th (N=1, 2, 3, . . . ) sheet, a post rotation instructor 107 instructs the engine 105 to perform post rotation (step S1070). When the post rotation is instructed, the engine 105 waits for the completion of page discharge processing, and performs the post rotation (step S1080). Note that as will be described later, the post rotation processing is performed after all the pages in a currently-processed job are discharged. Next, it is determined whether or not 90 seconds have elapsed from the start of execution of the post rotation processing (step S1090). If it is determined that 90 seconds have elapsed, the drive motor of the engine 105 is stopped (step S1100). In this manner, the post rotation processing for 90 seconds is performed.

On the other hand, at step S1060, if the number of print sheets is not 250×N (N=1, 2, 3, . . . ), the drive motor in the engine 105 is stopped at the same time of the completion of the page discharge processing (step S1110).

Note that the drive motor of the engine 105 is a main motor to drive the paper feed roller 1009, the conveyance rollers 1010 and 1011, the electrostatic drum 1006, and fixing rollers 1013*a* and 1013*b* of the fixer 1013 to convey a print sheet from the paper cassette 1008 and discharge the print sheet as shown in FIG. 1. In the present embodiment, upon the post rotation processing, the respective rollers are driven since the main motor drives, however, it is important to rotate the fixing rollers but it is not necessary to rotate the other rollers.

Note that in the first embodiment, the processing is performed in a case where print data is received from the host computer, however, this does not pose any limitation on the present invention. Similar processing is performed upon offline printing such as test printing or font list printing to print fonts stored in the printer.

Figure 5:
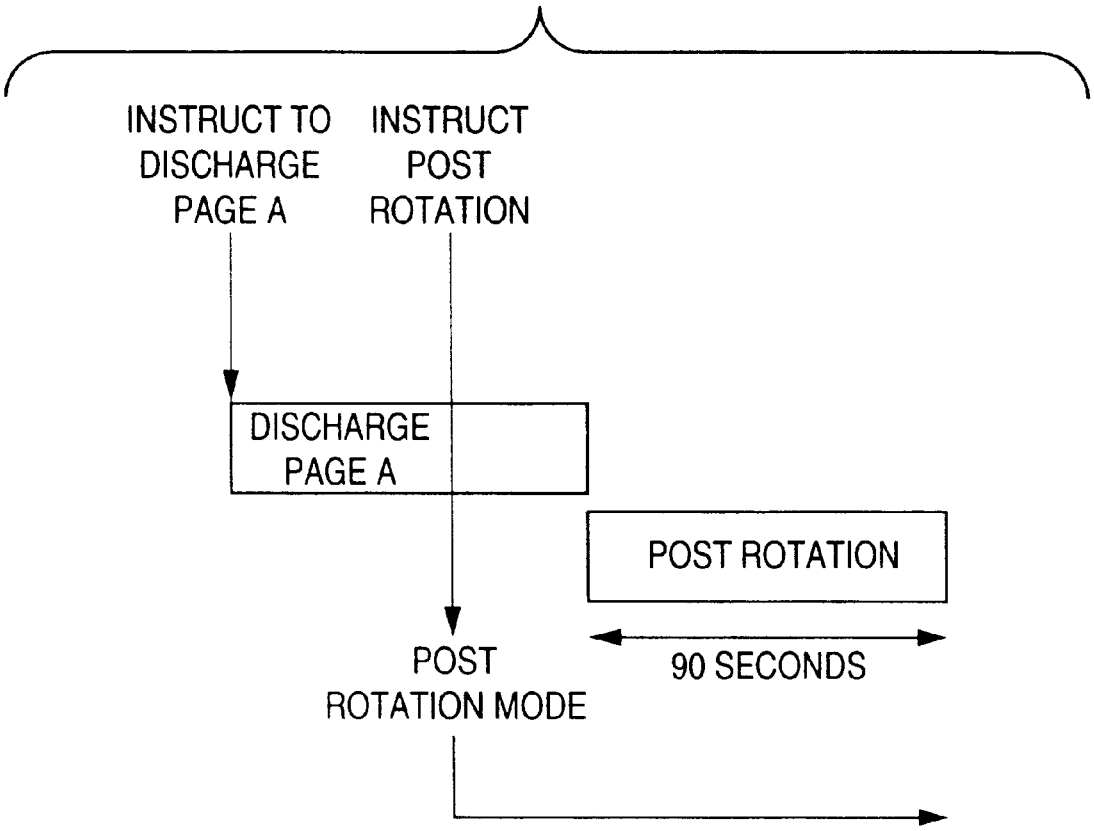
FIG. 5 is a schematic diagram showing the relation between a page discharge status and a post rotation status of the image output apparatus according to the first embodiment.

FIG. 5 shows the relation between a page discharge status and a post rotation status in the engine 105 in case of printing for one page. if the post rotation is instructed while a page A is discharged, the post rotation is performed for 90 seconds after the completion of discharge of the page A.

Next, processing in a case where the number of print sheet has become 250×N during printing for consecutive pages will be described.

Figure 6A:
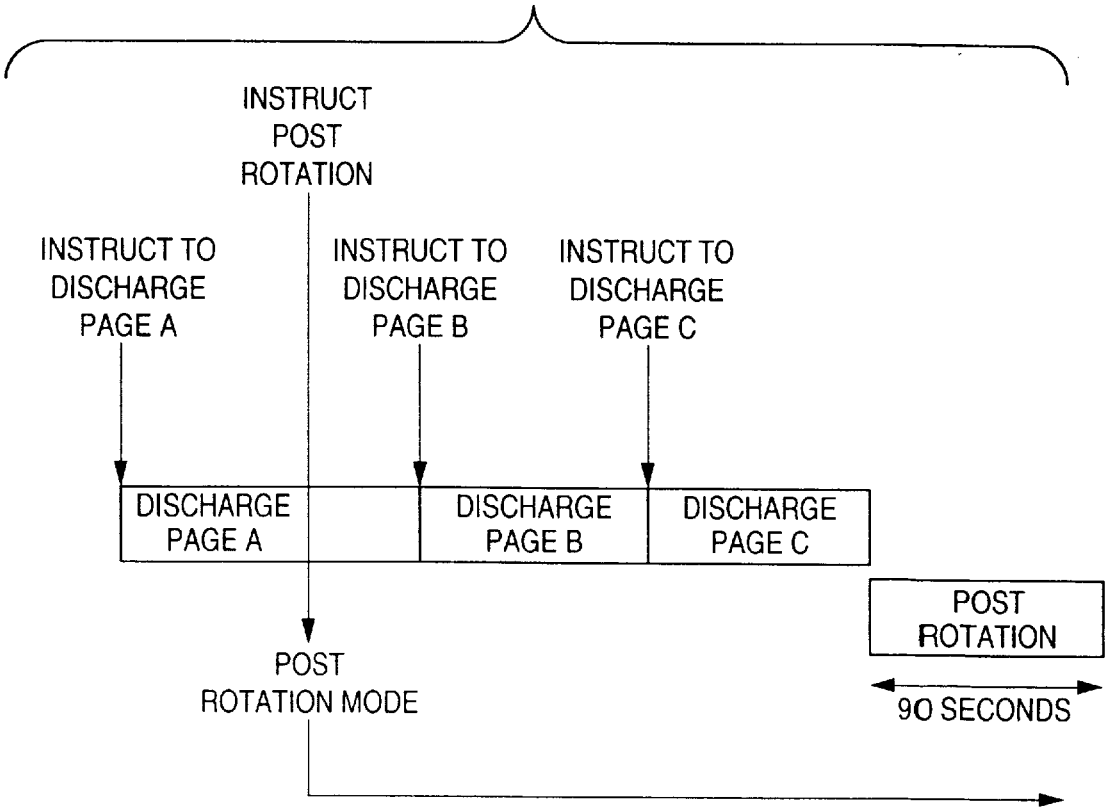
FIG. 6A is a schematic diagram showing the relation between the page discharge status and the post rotation status of the image output apparatus according to the first embodiment.

FIG. 6A shows the relation between the page discharge status and the post rotation status in the engine 105 in consecutive page printing. When the post rotation is instructed while the page A is discharged, pages B and C are discharged following the completion of discharge of the page A, and after the completion of discharge of the page C, the post rotation is performed for 90 seconds.

Figure 6B:
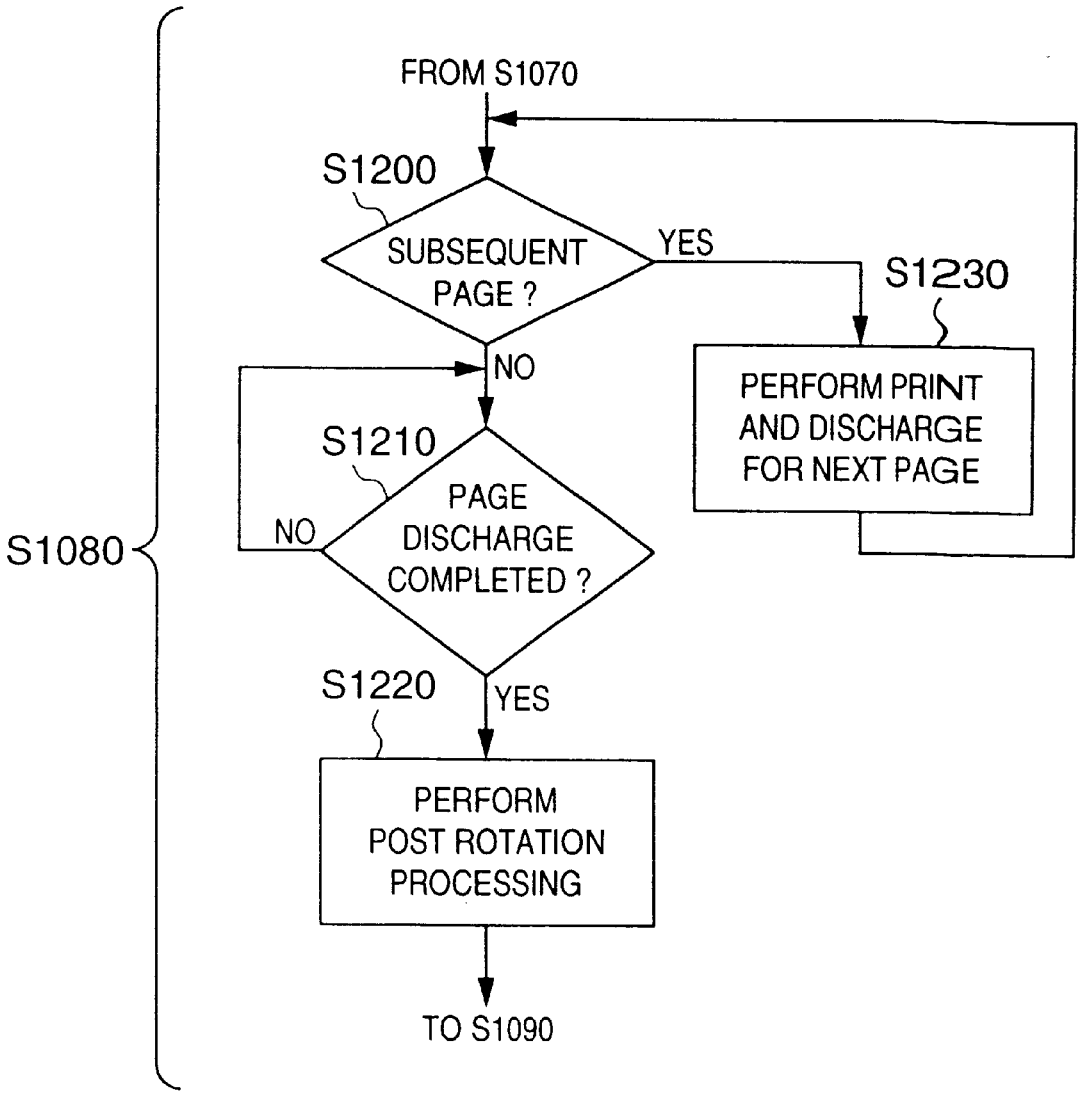
FIG. 6B is a flowchart showing an execution procedure of post rotation processing.

FIG. 6B is a flowchart showing an execution procedure of the post rotation processing in FIG. 6A. Note that FIG. 6B shows the processing at step S1080 in FIG. 4 in detail. If the post rotation is instructed at step S1070, it is determined at step S1200 whether or not a subsequent page for printing and discharging exists. If there is no subsequent page, the process proceeds to step S1210, at which the completion of the current page is waited. Then the reserve rotation processing is performed (step S1220). On the other hand, if a subsequent page exists, the process proceeds to step S1230, at which printing and discharging of the subsequent page is performed after the completion of discharge of the current page. Then the process returns to step S1200. Thus the processing as shown in FIG. 6A is realized by the above control.

Note that in the above example, consecutive three pages are processed, however, the number of pages is not limited to three. In case of four or more pages, the post rotation is performed for 90 seconds after the completion of discharge of the final page.

According to the experiment by the present inventors, it has been proved that the occurrence of fixing offset is prevented or reduced by additional rotation of the fixing rollers as in the first embodiment, and the above post rotation processing is very effective on the fixing offset.

As described above, according to the first embodiment, as the post rotation is performed after the completion of discharge of 250×N-th (N=1, 2, 3, . . . ) page, the problem of quality degradation due to fixing failure such as fixing offset can be prevented.

<Second Embodiment>

In the first embodiment, the post rotation processing is performed every predetermined number of print sheets, and during the execution of the post rotation processing, printing cannot be performed. In the second embodiment, printing can be performed even during the post rotation.

Figure 7:
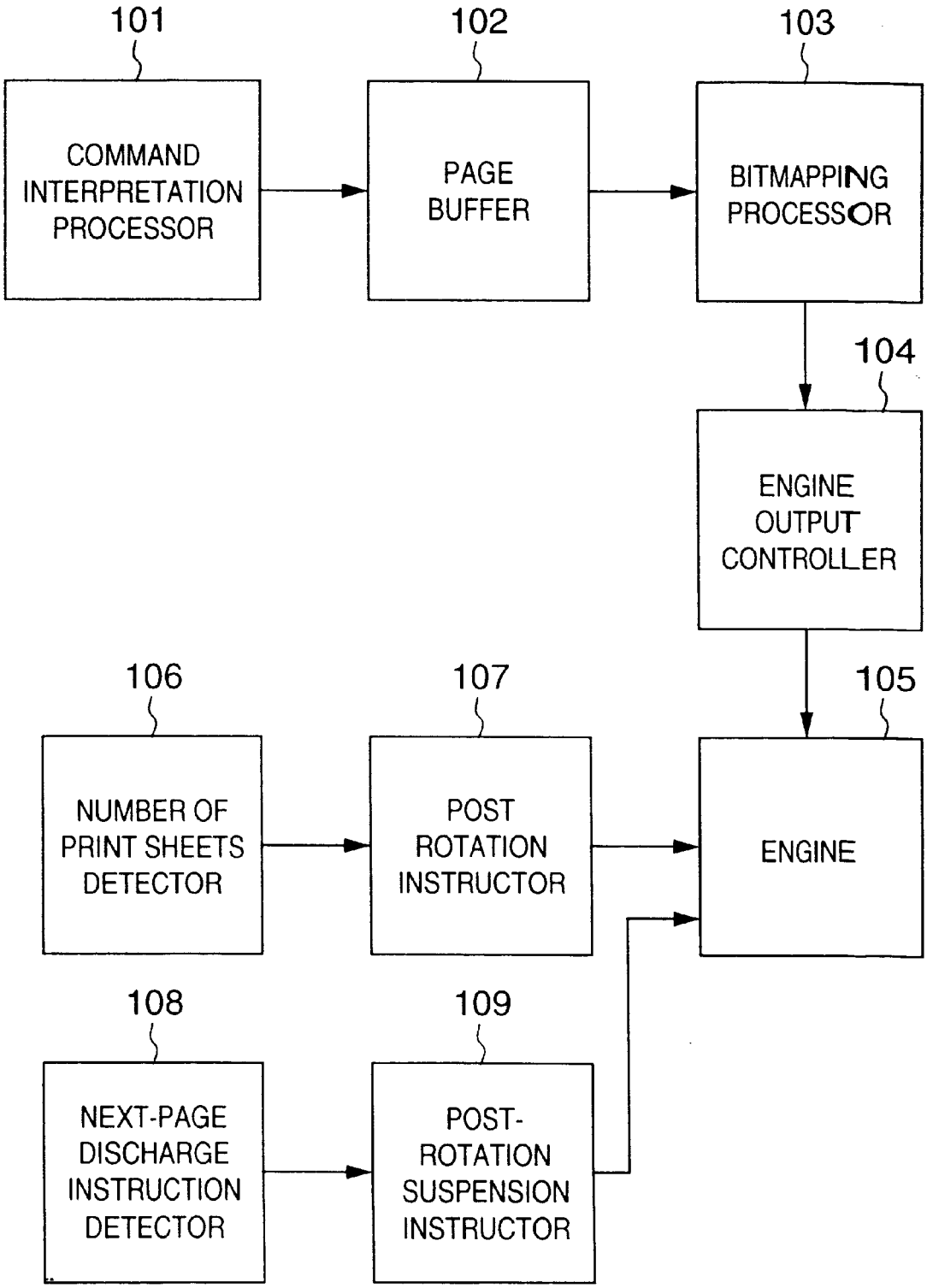
FIG. 7 is a block diagram showing the functional construction of the image output apparatus according to a second embodiment.

FIG. 7 is a block diagram showing the functional construction of the printer according to the second embodiment. In the second embodiment, upon printing for a 250×N-th (N=1, 2, 3, . . . ) page, the post rotation is performed. In a case where discharge processing for the next page is performed during the post rotation, the post rotation is suspended, and the discharge processing for the next page is performed. Note that in FIG. 7, blocks having the same functions as those of corresponding blocks in FIG. 3 of the first embodiment have the same reference numerals.

Hereinbelow, the processing according to the second embodiment will be described with reference to the block diagram of FIG. 7 and the flowchart of FIG. 8.

When data is inputted from the host computer (not shown), the data is temporarily stored in the reception buffer (not shown), and the command interpretation processor 101 performs interpretation and editing on the command and generates intermediate data (steps S2000 and S2010). The generated intermediate data is stored in the page buffer 102 (step S2020). The intermediate data stored in the page buffer 102 is sent to the bitmapping processor 103 and bitmapped (step S2030). When the bitmapping processing is completed, the drive motor (not shown) of the engine 105 is started (step S2040). The bitmap is outputted by the engine output controller 104 in synchronization with the engine synchronizing signal (not shown) to the engine 105 and printing and page discharge processing are performed (step S2050).

The number of print sheet detector 106 determines whether or not the number of print sheets is 250×N (N=1, 2, 3, . . . ). If the current page is a 250×N-th (N=1, 2, 3, . . . ) page, the post rotation instructor 107 instructs the engine 105 to perform the post rotation (step S2070). A next-page discharge instruction detector 108 detects whether or not a discharge for the next page has been instructed (step S2080). If discharge for the next page has been instructed, discharge processing for the next page is performed after the completion of the discharge processing for the current page (step S2090).

On the other hand, at step S2080, if discharge of the next page has not instructed, the post rotation is performed after the completion of discharge processing for the current page (step S2100), and it is determined whether or not 90 seconds have elapsed (step S2110). If it is determined that 90 seconds have elapsed, the drive motor of the engine 105 is stopped (step S2120).

In the second embodiment, until it is determined that the period of execution of the post rotation processing has become 90 seconds, it is detected again whether or not discharge of the next page has been instructed (step S2080). If discharge of the next page has been instructed during the execution of the post rotation processing, the process proceeds to step S2090, then the post rotation processing is suspended by the post rotation suspension instructor 109 and the instructed discharge of the next page is executed. Then, when the discharge processing has been completed, the process advances via step S2080 to step S2100, at which the suspended post rotation processing is resumed. On the other hand, if it is determined at step S2060 that the current page is not a 250×N-th (N=1, 2, 3, . . . ) page, the drive motor is stopped at the same time of the completion of page discharge processing in the engine 105 (step S2130).

Figure 9:
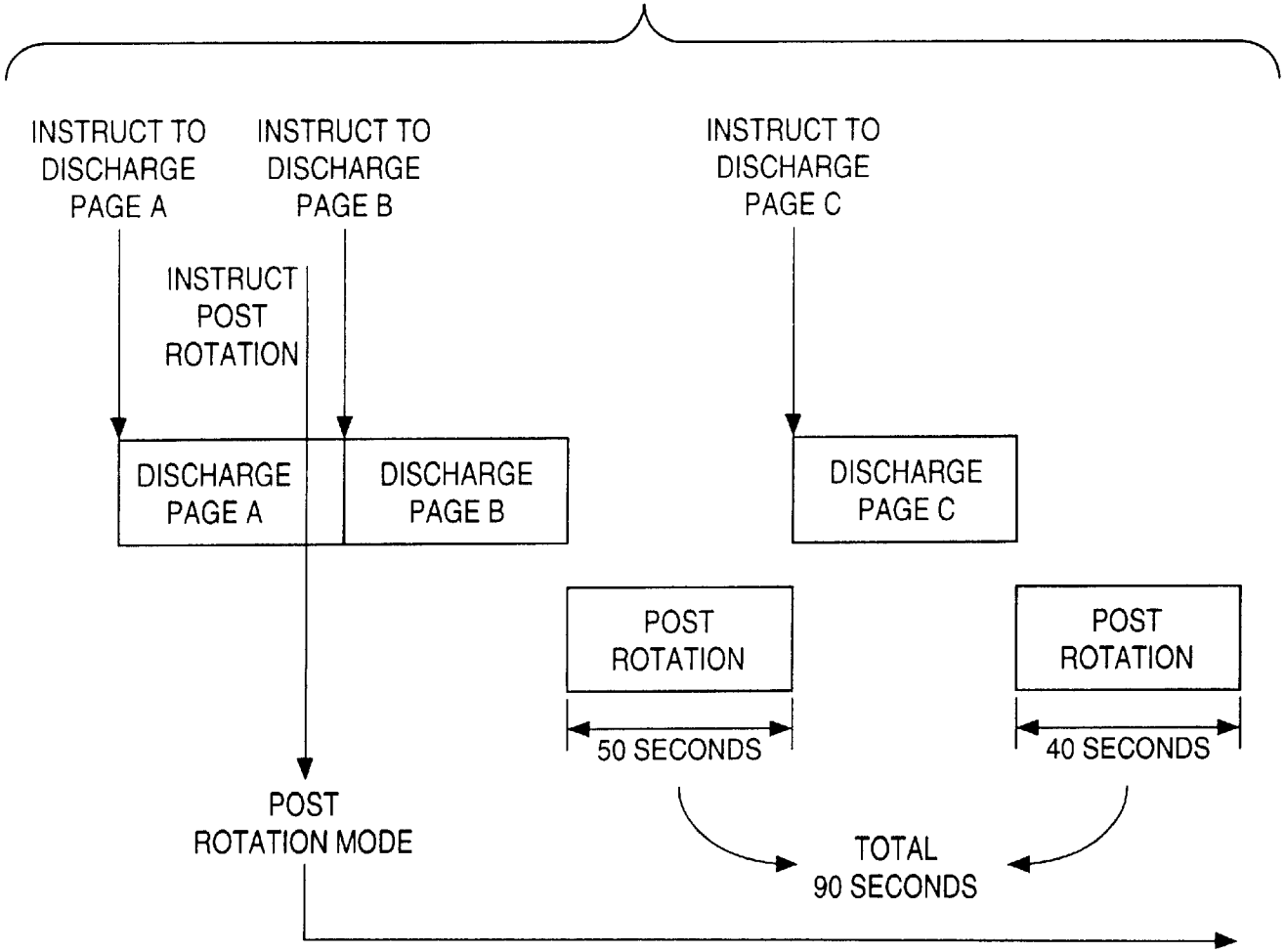
FIG. 9 is a schematic diagram showing the relation between the page discharge status and the post rotation status of the image output apparatus according to the second embodiment.

FIG. 9 shows the relation between the page discharge status and the post rotation status in the engine 105 in a case where discharge processing for the next page is performed during the post rotation, according to the second embodiment. The pages A and B are consecutive pages. Assuming that the post rotation processing is performed after the completion of discharge of the page B and discharge of a page C is instructed after elapse of 50 seconds, the post rotation processing is suspended at this point, and the discharge processing for the page C is performed. Then, after the completion of the discharge of the page C, the remaining post rotation processing is performed for 40 seconds.

As described above, according to the second embodiment, the post rotation is performed after the completion of discharge of 250×N-th (N=1, 2, 3, . . . ) page. If discharge of the next page is instructed during the execution of the post rotation, the post rotation is suspended, and the post rotation is performed after the completion of the discharge of the next page. Thus, even while the post rotation is being instructed or during the post rotation, the next page can be discharged without waiting for the completion of the post rotation processing.

<Third Embodiment>

In the second embodiment, when a discharge instruction has been received during the execution of the post rotation, the post rotation is suspended. In the third embodiment, if the printer moves to an offline status during the execution of the post rotation, the post rotation is suspended.

Note that "online" means a status where a printer can receive a print job transmitted from a host computer, while "offline" means a status where the printer cannot accept a print job from the host computer. The online status and offline status can be switched by an operation panel (not shown) or the like accompanying the printer. Further, if an operator call or error occurs in the printer, the printer automatically moves to the offline status.

Figure 10:
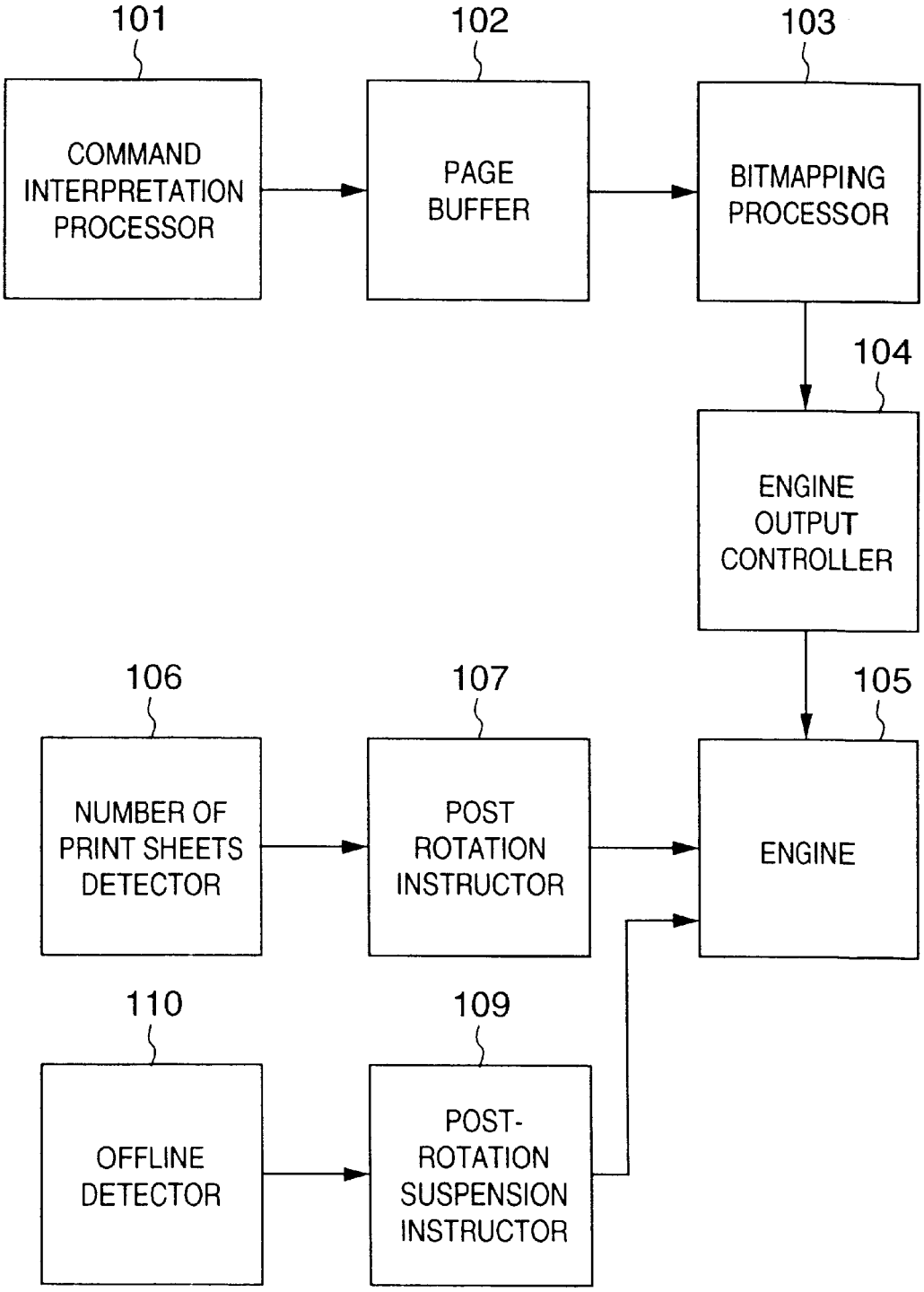
FIG. 10 is a block diagram showing the functional construction of the printer according to a third embodiment.

FIG. 10 is a block diagram showing the functional construction of the printer according to the third embodiment. In the third embodiment, the post rotation is performed upon printing for a 250×N-th (N=1, 2, 3, . . . ) page, and if offline processing is performed during the post rotation, the post rotation processing is suspended, then the printer moves to the offline status, and the remaining post rotation processing is performed after page discharge processing after the offline processing. Note that in FIG. 10, blocks having the same functions of those of corresponding blocks in FIGS. 3 and 7 of the first and second embodiment have the same reference numerals.

Hereinbelow, the control procedure of the printer according to the third embodiment will be described with reference to FIG. 10 and the flowchart of FIG. 11.

When data is inputted from the host computer (not shown), the data is temporarily stored in the reception buffer (not shown), then the command interpretation processor 101 performs interpretation and editing on the command and generates intermediate data (steps S3000 and S3010). The generated intermediate data is stored into the page buffer 102 (step S3020). The intermediate data stored in the page buffer 102 is sent to the bitmapping processor 103, and bitmapped (step S3030). When the bitmap processing has been completed, the drive motor (not shown) of the engine 105 is started (step S3040). The bitmap is outputted by the engine output controller 104 to the engine 105 in synchronization with the engine synchronizing signal (not shown) and then printing and page discharge processing are performed (step S3050).

The number of print sheets detector 106 determines whether or not the number of print sheets is 250×N (N=1, 2, 3, . . . )(step S3060). If the current sheet is a 250×N-th (N=1, 2, 3, . . . ) sheet, the post rotation instructor 107 turns a post rotation flag ON for the engine 105 (step S3070). An offline detector 110 detects whether or not the current status is the offline status (step S3080). If the current status is the offline status, a post rotation suspension instructor 109 performs post rotation suspension processing (step S3090), and the drive motor is stopped at the same time of the completion of the page discharge processing (step S3130).

On the other hand, if it is determined at step S3080 that the current status is the online status, the post rotation is performed after the completion of the page discharge processing (S3100). It is determined whether or not 90 seconds have elapsed (step S3110). If it is determined that 90 seconds have elapsed, the post rotation flag is turned OFF, and the drive motor of the engine 105 is stopped (step S3120). Until 90 seconds have elapsed since the start of execution of the post rotation processing, it is again detected whether or not the printer status has moved to the offline status (step S3080). If it is detected that the printer status has moved to the offline status during the post rotation processing, the post rotation suspension instructor 109 performs post rotation suspension processing (step S3090), to stop the drive motor (step S3130).

On the other hand, if it is determined that the current page is not a 250×N-th (N=1, 2, 3, . . . ) page, it is determined whether or not the post rotation flag is ON (step S3140). If the post rotation flag is OFF, the drive motor is stopped in the engine 105 at the same time of the completion of the page discharge processing (step S3130).

Note that if the post rotation flag is ON, the post rotation is performed by the engine 105 after the completion of the page discharge. In a case where the post rotation is suspended via step S3090 as described above, the post rotation flag is ON. Accordingly, even if it is not determined at step S3060 that the number of print pages is 250×N (N=1, 2, 3, . . . ), the process proceeds from step S3140 to step S3080, to perform (i.e., resume) the post rotation processing. Further, until 90 seconds have elapsed since the start of the post rotation, a timer (not shown) accompanying the engine 105 operates. When the post rotation suspension processing is performed, the period of post rotation by the point is stored into a memory (not shown) of the engine 105.

That is, in the post rotation suspension processing at step S3090, the post rotation processing executed period (or remaining period) is held. Then, when the post rotation processing is resumed at step S3100, the post rotation processing is controlled by referring to the held executed period (or the remaining period) so as to perform the processing for the total execution period of 90 seconds.

Next, post rotation processing resume processing will be described with reference to FIGS. 10 and 11, about a case where the discharge processing for the next page is performed in the post rotation suspension processing before the execution period of the post rotation processing becomes 90 seconds.

Since steps S3000 to S3060 are identical to those in the previous example, the explanation of these steps will be omitted. At this timing, as the number of discharged sheets has incremented by one, the number of print pages is not a multiple of 250. The process proceeds to step S3140, at which it is determined whether or not the post rotation flag is ON. If the post rotation flag is ON, i.e., the post rotation suspension processing is performed before the post rotation has been performed for 90 seconds, the offline detector 110 detects whether or not the current status is the offline status (step S3080). If the current status is the online status, the post rotation is performed after the completion of the page discharge processing (step S3100). It is determined by the timer (not shown) accompanying the engine 105 whether or not 90 seconds have elapsed (step S3110). If it is determined that 90 seconds have elapsed, the post rotation flag is turned OFF, and the drive motor of the engine 105 is stopped (step S3120).

The processing in a case where it is detected at step S3080 that the current status is the offline status, and the processing until 90 seconds have elapsed at step S3110 are the same as those as described above.

Note that as test print data, font list and the like contained in the printer are offline-printed, the post rotation processing is not performed after test printing, font list printing and the like. However, if the printer status moves to the online status before page discharge of test printing or font list printing, the post rotation processing is performed after the page discharge.

As described above, according to the third embodiment, the post rotation is performed after the completion of discharge of 250×N-th (N=1, 2, 3, . . . ) page. If the printer moves to the offline status, the post rotation is suspended, and the post rotation is resumed after the completion of discharge of the next page after the online processing. Accordingly, even when the post rotation is being instructed or during the execution of the post rotation, offline processing and predetermined panel operation can be performed without waiting for the completion of the post rotation processing.

Note that in the above first to third embodiments, the post rotation processing is performed after the completion of discharge of 250×N-th (N=1, 2, 3, . . . ) page, however, this does not pose any limitation on the present invention. It may be arranged such that the post rotation is performed every time the number of print pages becomes a value less or greater than 250×N. Further, the interval between post rotation processing may be reduced in proportion to increase in the total number of print pages.

Further, in the above first to third embodiment, the post rotation processing is performed after the completion of discharge of 250×N-th (N=1, 2, 3, . . . ) page, however, this does not pose any limitation on the present invention. It may be arranged such that the number of revolutions of the fixer is detected and the post rotation processing is performed every predetermined number of revolutions.

Further, in the above first to third embodiments, the execution period per one post rotation processing is 90 seconds, however, the period is not limited to 90 seconds. The execution period may be set to a period shorter than or longer than 90 seconds. Further, it may be arranged such that the execution period of the post rotation processing is increased in proportion to increase in the number of total print pages.

Further, in the above first to third embodiments, the post rotation processing is made by operating the drive motor to drive the entire drive system, however, this does not pose any limitation on the present invention. It may be arranged such that only the fixer is driven.

As described above, according to the present invention, the problems in quality degradation due to fixing failure such as fixing offset can be prevented at a low cost, by rotating the fixing rollers at timing other than paper discharge processing time.

Furthermore, the present invention can be applied to the system comprising either a plurality of units or a single unit. Further, the present invention can be applied to the case which can be attained by supplying programs which execute the process defined by the present system or invention.

As many apparently widely different embodiments of the present invention can be made without departing from the spirit and scope thereof, it is to be understood that the invention is not limited to the specific embodiments thereof except as defined in the appended claims.

What is claimed is:

1. An image output apparatus comprising:

transfer means for transferring a toner image generated based on image information onto a print sheet;

fixing means, having fixing rollers, for fixing the toner image transferred onto said print sheet to said print sheet;

rotation control means for performing an additional rotation in which said fixing rollers are additionally rotated for a predetermined period; and instruction means for instructing said rotation control means to perform the additional rotation when a predetermined condition is satisfied, wherein, if the additional rotation is instructed during image output operation, said rotation control means performs the additional rotation after completion of said image output operation.

2. The image output apparatus according to claim 1, further comprising detection means for detecting whether or not a predetermined number of pages have been discharged, wherein if said detection means detects that the predetermined number of pages have been discharged, said instruction means instructs said rotation control means to perform the additional rotation.

3. The image output apparatus according to claim 2, wherein if a currently-processed job has a subsequent page when it is instructed by said instruction means to perform the additional rotation, said rotation control means rotates said fixing rollers for the predetermined period after completion of discharge of the pages.

4. An image output apparatus comprising:

transfer means for transferring a toner image generated based on image information onto a print sheet;

fixing means, having a fixing roller, for fixing the toner image transferred onto said print sheet to said print sheet;

rotation control means for rotating said fixing roller for a predetermined period at timing other than that of fixing operation; and suspension means for suspending rotation processing by said rotation control means if discharge of a new page is instructed during rotation of said fixing roller by said rotation control means.

5. The image output apparatus according to claim 4, further comprising resume means for resuming the rotation of said fixing roller by said rotation control means after execution of the suspension processing by said suspension means and after the discharge of the new page.

6. The image output apparatus according to claim 5, wherein a rotation period of said fixing roller by said resume means is a remaining period between a point where the rotation is suspended by said suspension means to the end of said predetermined period.

7. An image output apparatus comprising:

transfer means for transferring a toner image generated based on image information onto a print sheet;

fixing means, having a fixing roller, for fixing the toner image transferred onto said print sheet to said print sheet;

rotation control means for rotating said fixing roller for a predetermined period at timing other than that of fixing operation; and suspension means for suspending rotation processing by said rotation control means if a current apparatus status moves to an offline status during rotation of said fixing roller by said rotation control means.

8. The image output apparatus according to claim 7, further comprising resume means for resuming the rotation of said fixing roller by said rotation control means after the current apparatus status returns to an online status after execution of suspension processing by said suspension means and after the discharge of a new page.

9. The image output apparatus according to claim 8, wherein a rotation period of said fixing roller by said resume means is a remaining period between a point where the rotation is suspended by said suspension means to the end of said predetermined period.

10. An image output apparatus control method comprising:

a transfer step of transferring a toner image generated based on image information onto a print sheet;

a fixing step of fixing the toner image transferred onto said print sheet to said print sheet by using a pair of fixing rollers;

a rotation control step of performing an additional rotation in which said pair of fixing rollers are additionally rotated for a predetermined period; and an instruction step of instructing the rotation control step to perform the additional rotation when a predetermined condition is satisfied, wherein, if the additional rotation is instructed during image output operation, the rotation control step performs the additional rotation after completion of said image output operation.

11. The image output apparatus control method according, to claim 10, further comprising a detection step of detecting whether or not a predetermined number of pages have been discharged, wherein if it is detected at said detection step that the predetermined number of pages have been discharged, the instruction step instructs the rotation control step to perform the additional rotation.

12. The image output apparatus control method according to claim 11, wherein if a currently-processed job has a subsequent page when it is instructed at said instruction step to perform the additional rotation, said fixing rollers are additionally is rotated for the predetermined period after completion of discharge of the pages, at said rotation control step.

13. An image output apparatus control method comprising:

a transfer step of transferring a toner image generated based on image information onto a print sheet;

a fixing step of fixing the toner image transferred onto said print sheet to said print sheet by using a fixing roller;

a rotation control step of rotating said fixing roller for a predetermined period at timing other than that of fixing operation; and a suspension step of suspending rotation processing by said rotation control means if discharge of a new page is instructed during rotation of said fixing roller at said rotation control step.

14. The image output apparatus control method according to claim 13, further comprising a resume step of resuming the rotation of said fixing roller at said rotation control step after execution of the suspension processing at said suspension step and after the discharge of the new page.

15. The image output apparatus control method according to claim 14, wherein a rotation period of said fixing roller at said resume step is a remaining period between a point where the rotation is suspended at said suspension step to the end of said predetermined period.

16. An image output apparatus control method comprising:

a transfer step of transferring a toner image generated based on image information onto a print sheet;

a fixing step of fixing the toner image transferred onto said print sheet to said print sheet by using a fixing roller;

a rotation control step of rotating said fixing roller for a predetermined period at timing other than that of fixing operation; and a suspension step of suspending rotation processing at said rotation control step if a current apparatus status moves to an offline status during rotation of said fixing roller at said rotation control step.

17. The image output apparatus control method according to claim 16, further comprising a resume step of resuming the rotation of said fixing roller at said rotation control step after the current apparatus status returns to an online status after execution of suspension processing at said suspension step and after the discharge of a new page.

18. The image output apparatus control method according to claim 17, wherein a rotation period of said fixing roller at said resume step is a remaining period between a point where the rotation is suspended at said suspension step to the end of said predetermined period.

19. An image output apparatus comprising:

transfer means for transferring a toner image generated based on image information onto a print sheet;

fixing means, having fixing rollers, for fixing the toner image transferred onto said print sheet to said print sheet;

cleaning means for cleaning said fixing means for a predetermined period at a timing other than that of fixing operation; and instruction means for instructing a rotation control means to perform an additional rotation of the fixing rollers when a predetermined condition is satisfied, wherein, if the additional rotation is instructed during image output operation, said rotation control means performs the additional rotation after completion of said image output operation.

20. An image output apparatus comprising:

transfer means for transferring a toner image generated based on image information onto a print sheet;

fixing means, having a fixing roller, for fixing the toner image transferred onto said print sheet to said print sheet;

cleaning means for cleaning said fixing means for a predetermined period at a timing other than that of fixing operation; and suspension means for suspending rotation processing of the fixing roller by a rotation control means if discharge of a new page is instructed during rotation of said fixing roller by said rotation control means.

21. An image output apparatus comprising:

transfer means for transferring a toner image generated based on image information onto a print sheet;

fixing means, having a fixing roller, for fixing the toner image transferred onto said print sheet to said print sheet;

cleaning means for cleaning said fixing means for a predetermined period at a timing other than that of fixing operation; and suspension means for suspending rotation processing of the fixing roller by a rotation control means if a current apparatus status moves to an offline status during rotation of said fixing roller by said rotation control means.

* * * * *

UNITED STATES PATENT AND TRADEMARK OFFICE

CERTIFICATE OF CORRECTION

PATENT NO. : 6,438,334 B1
DATED : August 20, 2002
INVENTOR(S) : Koichi Honma

It is certified that error appears in the above-identified patent and that said Letters Patent is hereby corrected as shown below:

Column 3,
Line 39, “roller” should read -- rollers --; and
Line 45, “on” should read -- of --.

Column 5,
Line 62, “if” should read -- If --; and
Line 65, “sheet” should read -- sheets --.

Column 7,
Line 15, “instructed,” should read -- been instructed, --.

Column 8,
Lines 45 and 66, “of” (first occurrence) should read -- as --.

Column 10,
Line 8, “embodiment,” should read -- embodiments, --.

Column 11,
Line 59, “a pair of” should be deleted; and
Line 62, “pair of” should be deleted.

Column 12,
Line 5, “according,” should read -- according --; and
Line 17, “is” should be deleted.

Signed and Sealed this

Twenty-second Day of July, 2003

JAMES E. ROGAN
*Director of the United States Patent and Trademark Office*